US007661552B2

(12) United States Patent
Baum et al.

(10) Patent No.: US 7,661,552 B2
(45) Date of Patent: Feb. 16, 2010

(54) INTERFOLDED DISPENSING PANEL

(75) Inventors: Scott Allen Baum, Hortonville, WI (US); Charlcie C. K. Leitner, Appleton, WI (US); Leslie Thomas Long, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 473 days.

(21) Appl. No.: 11/504,311

(22) Filed: Aug. 15, 2006

(65) Prior Publication Data

US 2008/0041873 A1 Feb. 21, 2008

(51) Int. Cl.
*B65H 3/68* (2006.01)

(52) U.S. Cl. ..... 221/41; 221/37; 221/38; 221/50; 221/55

(58) Field of Classification Search ..... 221/37, 221/38, 41, 48, 49, 50, 55, 62
See application file for complete search history.

(56) References Cited

U.S. PATENT DOCUMENTS

| | | | | | |
|---|---|---|---|---|---|
| 2,269,039 | A | * | 1/1942 | Ross | 221/50 |
| 3,207,360 | A | * | 9/1965 | Scott | 221/48 |
| 3,239,097 | A | | 3/1966 | Bates et al. | |
| 3,473,694 | A | * | 10/1969 | Dewhurst et al. | 221/63 |
| 3,970,215 | A | * | 7/1976 | McLaren et al. | 221/45 |
| 3,979,019 | A | * | 9/1976 | Bliss | 221/48 |
| 4,574,952 | A | * | 3/1986 | Masui | 221/48 |
| 5,316,177 | A | | 5/1994 | Boldt | |
| 5,415,320 | A | | 5/1995 | North et al. | |
| 5,501,323 | A | | 3/1996 | Denesha et al. | |
| 5,540,354 | A | | 7/1996 | Annand | |
| 5,622,281 | A | | 4/1997 | Annand | |
| 5,868,276 | A | | 2/1999 | Loppnow et al. | |
| 5,967,321 | A | | 10/1999 | Sigl | |
| 6,068,583 | A | | 5/2000 | Sigl | |
| 6,550,639 | B2 | | 4/2003 | Brown et al. | |
| 6,672,475 | B1 | | 1/2004 | Ho et al. | |
| 6,715,633 | B2 | | 4/2004 | Thoms | |
| 6,959,834 | B2 | | 11/2005 | McDonald | |
| 6,964,349 | B2 | | 11/2005 | Sears et al. | |
| 2006/0151516 | A1 | | 7/2006 | Etheridge et al. | |

FOREIGN PATENT DOCUMENTS

| | | |
|---|---|---|
| WO | WO 2005/113381 | 12/2005 |

* cited by examiner

*Primary Examiner*—Gene Crawford
*Assistant Examiner*—Timothy R Waggoner
(74) *Attorney, Agent, or Firm*—Gregory E. Croft; Scott A. Baum

(57) ABSTRACT

By interfolding or interleaving at least a portion of the dispensing panel of a dispenser with the first sheet in a stack of sheet material such that a leading edge of the first sheet is exposed, it is no longer necessary to reach into the dispenser to dispense the first sheet. To dispense the first sheet, the optional removable panel is torn from the dispenser, and then the already exposed leading edge of the first sheet protruding from the dispensing panel is grasped and pulled to withdraw the first sheet from the dispenser.

16 Claims, 7 Drawing Sheets

INTERFOLDED DISPENSING PANEL

BACKGROUND

Dispensers for sheet materials, such as facial tissue, are often provided with the sheets in the dispenser interfolded or interleaved with adjacent sheets such that the withdrawal of one sheet partially exposes the subsequent sheet in the dispensing opening of the dispenser. Partially exposing the next sheet enables a person needing a facial tissue to easily grab the exposed end to quickly dispense the sheet. Frequently, this type of dispensing is referred to as pop-up dispensing. Often, to prevent debris from entering the dispenser, to reduce multiple sheets from dispensing, or to assist with retaining the partially exposed sheet within the dispensing opening, a dispensing window constructed from a clear film or plastic material is provided. Typically, a slit or other restricted opening is present in the dispensing window to retain the partially exposed sheet within the opening. While a narrow slit in the dispensing window can assist with presenting tissue sheets for subsequent removal, it is sometimes difficult to remove the initial sheet from the dispenser due to the narrowness of the slit. For instance, the narrow slit can interfere with the ability of a person opening a new tissue carton to locate and find the leading edge of the first tissue sheet in the stack. Furthermore, the narrow slit may get distorted or damaged by inserting a portion of one's hand inside of the dispenser to retrieve the first sheet.

In order to assist with dispensing of the first tissue sheet, U.S. Pat. No. 4,574,952, entitled Box Containing Facial Tissue which granted Mar. 11, 1986, to Masui discloses a carton containing facial tissues in which double sided tape is attached to the undersurface of a removable panel of the carton and, in turn, attached to the uppermost sheet in the stack of facial tissues inside the dispenser. In this manner, when the carton is opened and the removable panel is detached along a perforated line, the uppermost facial tissue sheet is automatically removed from the container along with the removable panel.

U.S. Pat. No. 6,715,633, entitled Interfolded Sheet Dispenser Having a Starter Sheet Pull-Out System which granted Apr. 6, 2004, to Thoms describes a dispenser for dispensing a stack of disposable sheets having a removable panel that is releasably attached to the first sheet in the stack. When the removable panel is pulled off the dispenser, the first sheet in the stack is partially withdrawn from the container. After being partially withdrawn, the sheet releases from the removable panel.

Finally, pending U.S. patent application Ser. No. 11/216,468, entitled Tissue Sheet Dispenser And Process For Making Same filed Aug. 31, 2005, discloses a dispenser having the first sheet adhesively attached to a removable panel with the adhesive located in a recess in the removable panel. By placing the adhesive in a recess, the adhesive material is prevented from adhering to other portions of the dispensing container before the first sheet is attached.

Although the above references assist with dispensing the first tissue sheet, they can be difficult to implement in some embodiments. For example, if the dispensing window utilizes a narrow slit to dispense the tissue sheets, the dispensing window with the narrow slit disposed between the removable carton panel and the first tissue sheet can interfere with attaching the first tissue sheet to the removable panel. The adhesive or tape needs to attach the first tissue sheet to the removable panel while at the same time not sticking to the dispensing window.

Therefore, a need exists for quickly dispensing the first sheet of a stack of sheets in a dispenser that overcomes the above problems. More particularly, a need exists for locating and quickly dispensing the first sheet that is compatible with dispensing windows having a small opening or narrow slit.

SUMMARY

The inventors have discovered that the above needs can be met by interfolding or interleaving at least a portion of a dispensing panel with the first sheet in the stack such that a leading edge of the first sheet is exposed. To dispense the first sheet, the optional removable panel or surfboard is torn from the dispenser, and then the already exposed leading edge of the first sheet protruding from the dispensing panel is grasped and pulled to withdraw the first sheet from the dispenser. It is no longer necessary to insert a portion of one's hand through the dispensing panel to locate, grasp, and withdraw the first sheet.

Hence, in one aspect, the invention resides in a product comprising a stack of sheets and at least one dispensing panel placed adjacent to the stack, and a portion of the at least one dispensing panel interleaved with the stack.

BRIEF DESCRIPTION OF THE DRAWINGS

The above aspects and other features, aspects, and advantages of the present invention will become better understood with regard to the following description, appended claims, and accompanying drawings in which:

Figure 1:
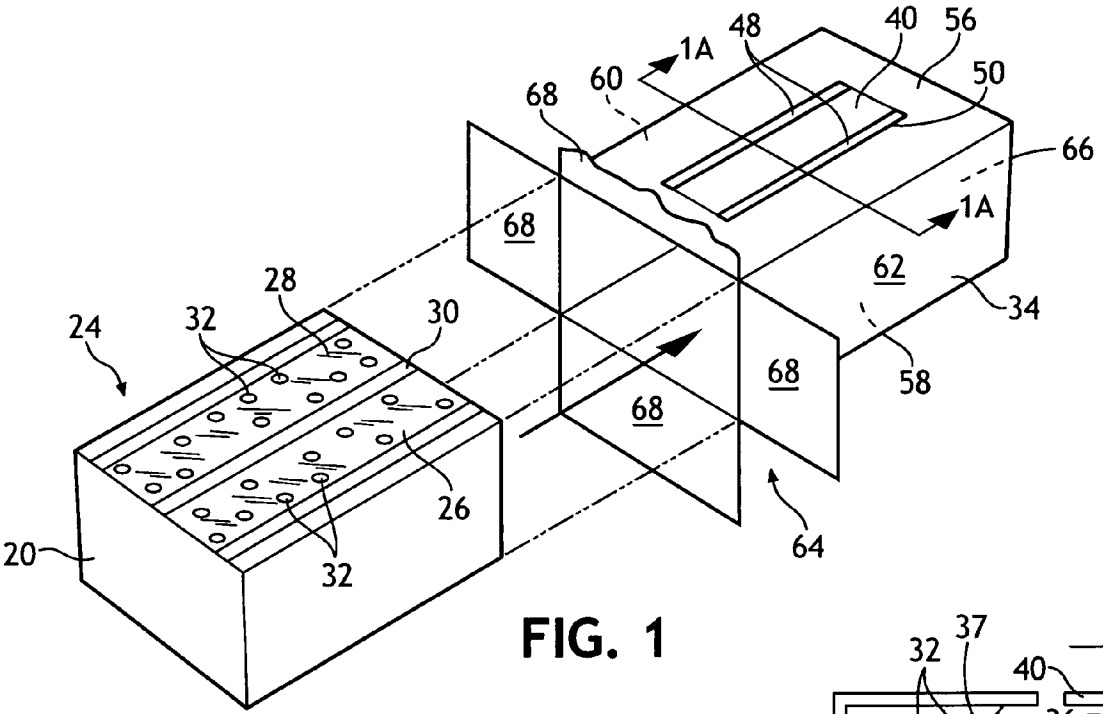
FIG. 1 is a perspective view of one embodiment of the invention.

Repeated use of reference characters in the specification and drawings is intended to represent the same or analogous features or elements of the invention in different embodiments.

DEFINITIONS

As used herein, forms of the words "comprise", "have", and "include" are legally equivalent and open-ended. Therefore, additional non-recited elements, functions, steps or limitations may be present in addition to the recited elements, functions, steps, or limitations.

As used herein, "top", "bottom", "left", or "right" are used for convenience when describing the particular structure involved in the illustrations and do no imply that the dispenser or stack must be orientated in a particular manner. For example, the dispenser could be invented for use under a shelf or table and the top could become the bottom.

As used herein "dispensing panel" is one or more thin pieces of material that have or form a dispensing orifice, such as a slit, that is generally secured to the dispenser's surface adjacent an opening into the dispenser. The dispensing panel provides assistance with dispensing the sheets located within the dispenser, such as preventing debris from entering the dispenser, reducing multiple sheets from dispensing, or assisting with retaining the partially exposed sheet within the dispensing opening. The dispensing panel can be made from any suitable film, plastic, paper, nonwoven, or cloth material. The film can be a polypropylene, polystyrene, polyester, polyvinylchloride, or polyethylene material. The film material can be uniaxially oriented, a multilayer material, clear, opaque, or printed. Suitable paper dispensing panels are disclosed in U.S. Pat. No. 5,316,177 entitled Facial Tissue Dispensing Carton that issued May 31, 1994 to Boldt. Suitable film and nonwoven dispensing panels are disclosed in U.S. patent application 2006/0151516 entitled Lint-Reducing Container published Jul. 13, 2006, by Etheridge et al.

DETAILED DESCRIPTION

It is to be understood by one of ordinary skill in the art that the present discussion is a description of exemplary embodiments only and is not intended as limiting the broader aspects of the present invention, which broader aspects are embodied in the exemplary construction.

Figure 1A:
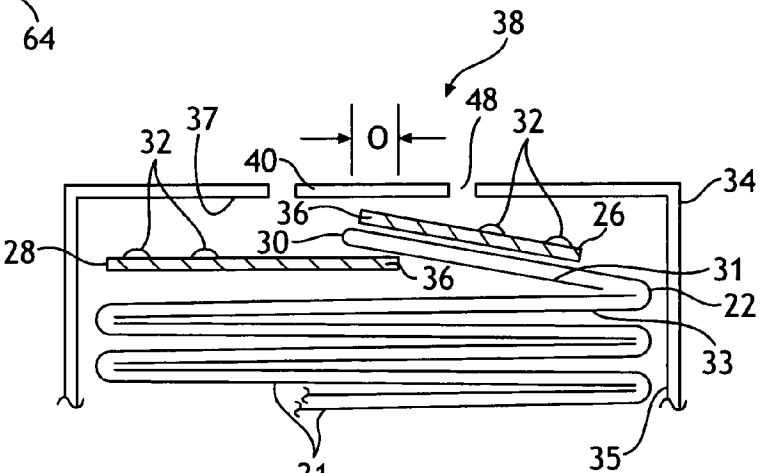
FIG. 1A is a partial cross-section view of FIG. 1.

Referring to FIGS. 1 and 1A, one embodiment of the invention is illustrated. A stack 20 of a plurality of interfolded sheets 21, such as facial tissue, napkins, paper towels, and wet wipes, is illustrated. Interleaved with the first sheet 22 of the stack 20 is at least one dispensing panel 24. The dispensing panel 24 can be a single piece of material as best seen in FIG. 3A, or multiple pieces that together form the dispensing panel.

In the illustrated embodiment, a first side dispensing panel 26 is placed over at least a portion of the right side of the first sheet 22. A second side dispensing panel 28 is placed over at least a portion of the left side of the first sheet 22 and interleaved with at least a portion of the first sheet 22 such that a leading edge 30 of the first sheet 22 is exposed between the first side and the second side dispensing panels (26, 28). The first sheet 22 in this embodiment is J-folded such that the leading edge 30 is formed where the first sheet is doubled back on itself. Such a folding configuration for the first sheet is disclosed in U.S. Pat. No. 5,868,276 entitled Folded Sheet Material Web and Assembly and Method and Apparatus Therefore and issued to Loppnow et al. on Feb. 9, 1999. Other folding configurations for the first sheet can be used.

The second side dispensing panel 28 is interleaved between a doubled over portion 31 of the first sheet 22 and a trailing panel 33 of the first sheet. The trailing panel 33 of the first sheet 22 is interleaved between the V-fold of the next sheet in the stack 20 and thereafter the interfolded sheets 21 are interleaved V-folded sheets to enable pop-up dispensing. The interfolded sheets within the stack 20 could be interleaved in another manner such as Z-folded or W-folded, fan folded and separated by perforated lines, adhesively attached, or otherwise constructed such that the withdrawal of one sheet from the stack partially withdraws or exposes the next sheet from the dispenser's opening.

After placing the first and the second side dispensing panels (26, 28) onto the stack 20, an adhesive 32 can be applied to the dispensing panels prior to inserting the stack into a dispenser 34. After insertion of the stack 20, the dispenser 34 can be inverted to attach the first side and the second side dispensing panels (26, 28) to an interior surface 35 of the dispenser such as the top interior surface 37 of the dispenser. The right and the left side dispensing panels (26, 28) are attached to the top interior surface 37 such that a portion of each panel extends into a dispensing opening 50 located in the dispenser 35. As such, to a consumer the dispenser 34 will appear and function similar to existing dispensers having a single piece of film adhered to the dispenser's top interior surface, having a small slit that forms the dispensing window; however, it will have a significant advantage in that the leading edge 30 of the first sheet 22 is exposed between the first and the second dispensing panels (26, 28), enabling the first sheet 22 to be easily grabbed and dispensed without having to search, reach-in or find it inside of the dispenser as previously required.

In previous dispensers, the dispensing window is attached by adhesive to the top interior surface of the dispenser while producing the carton blank that ultimately becomes the dispenser. After folding and gluing the carton blank with the attached dispensing window into a parallelepiped, the stack is inserted into an open end of the dispenser. As such, the leading edge of the stack is not exposed by the prior process since the dispensing window is not interleaved or interfolded with the stack. The leading edge remains within the interior of the dispenser until retrieved by a user to start the dispensing process.

To produce the product of FIG. 1, the material used for the first and the second dispensing panels (26, 28) can be provided in large rolls similar to the material that forms the interfolded sheets 21. The first and the second dispensing panel rolls can be unwound, guided, placed, and interleaved using folding boards in a process similar to interfolding the sheets 21. The resulting continuous sausage of interfolded sheets having the first and the second dispensing panels (26, 28) located at the top of the stack can then be cut to length using an orbital saw to form the stack 20 of FIG. 1.

One advantage of the new process is the interfolded sheets 21, the first side dispensing panel 26, and the second side dispensing panel 28 can be placed, folded or interleaved using a multi-folder converting line. Therefore, it is possible to guide the first and the second dispensing panels (26, 28) to form either an overlap distance O, a slit with no gap, or to provide a gap G between the dispensing edge 36 of each dispensing panel to create differently shaped or sized dispensing orifices 38 for the dispenser 34.

In another embodiment, since the leading edge 30 of the first sheet 22 is exposed, it is also possible to apply adhesive 32 to the leading edge 30 in order to attach the first sheet 22 to a removable panel 40 of the dispenser 34. In this manner, the first sheet can be fully or partially withdrawn when the removable panel 40 is detached from the dispenser 34. However, with at least one dispensing panel 24 interleaved with the stack 20, it is possible to attach the first sheet 22 to the removable panel 40 and have either a gap G or an overlap O for the dispensing orifice 38. In the various embodiments, the removable panel 40 covers at least a portion of the dispensing opening 50. Preferably, the removal panel extends the length of the dispensing opening 50 and covers the dispensing edges 36 and the leading edge 30 of the first sheet 22. In order to more easily remove the removable panel 40, preferably a cutout 48 is present on opposing sides of the removable panel.

Figure 2:
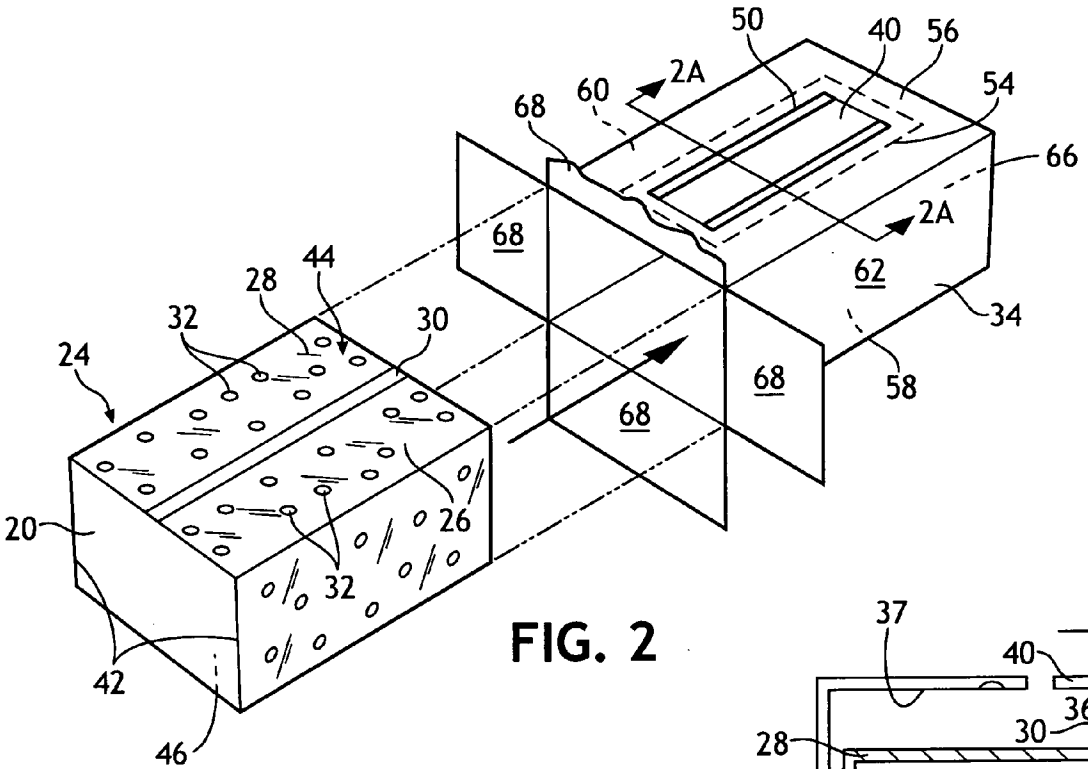
FIG. 2 is a perspective view of another embodiment of the invention.
Figure 2A:
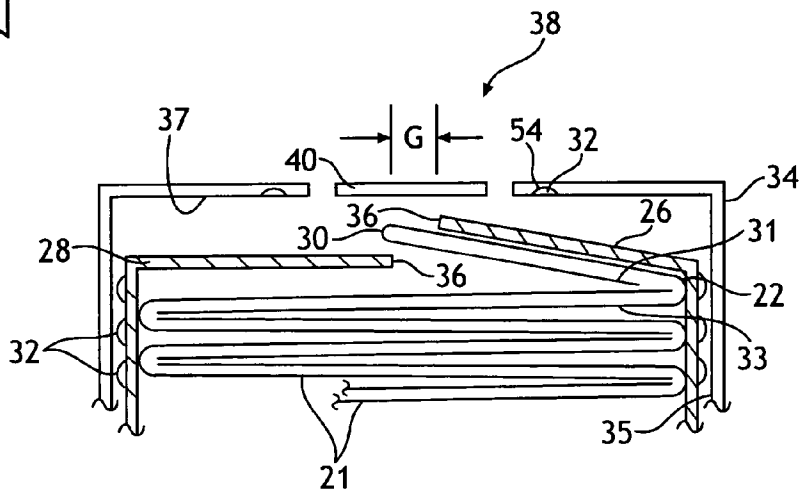
FIG. 2A is a partial cross-section view of FIG. 2.

Referring now to FIGS. 2 and 2A, another embodiment of the invention is illustrated. This embodiment is similar to the embodiment of FIG. 1 except that the first and the second dispensing panels (26, 28) cover at least a portion of the top 44 and the sides 42 of the stack 20. The first side dispensing panel 26 is placed over a portion of the top 44 and a portion of the right side of the stack 20. The second side dispensing panel 28 is placed over a portion of the top 44 of the stack and a portion of the left side of the stack 20. In one embodiment, the first and the second dispensing panels (26, 28) cover the sides 42 of the stack 20 from the top 44 to the bottom 46 of the stack. The ends of the stack 20 can be exposed if the stack is cut to length with the dispensing panel positioned about the continuous stack. Substantially the entire top 44 of the stack 20 is covered by the dispensing panels. A small portion of the top 44 may be uncovered if a gap G is present between the dispensing edges 36 of the first and the second dispensing panels (26, 28) rather than an overlap O. The dispensing orifice 38 can have a gap G, an overlap O, or a slit with no gap between the dispensing edges 36 of the dispensing panels.

This embodiment can provide more surface area to glue the dispensing panels to the interior surface 35 of the dispenser 34 and can reduce the dispensing force needed to remove the first sheet 22. Often the coefficient of friction for a tissue sheet on a film surface can be less than for a tissue sheet on a paperboard surface. Since all or a significant portion of the interfolded sheets 21 in the stack are mostly in contact with the first and the second dispensing panel (26, 28), it can be easier to remove them from the dispenser 34; especially, when the dispenser is full or nearly full.

Figure 3:
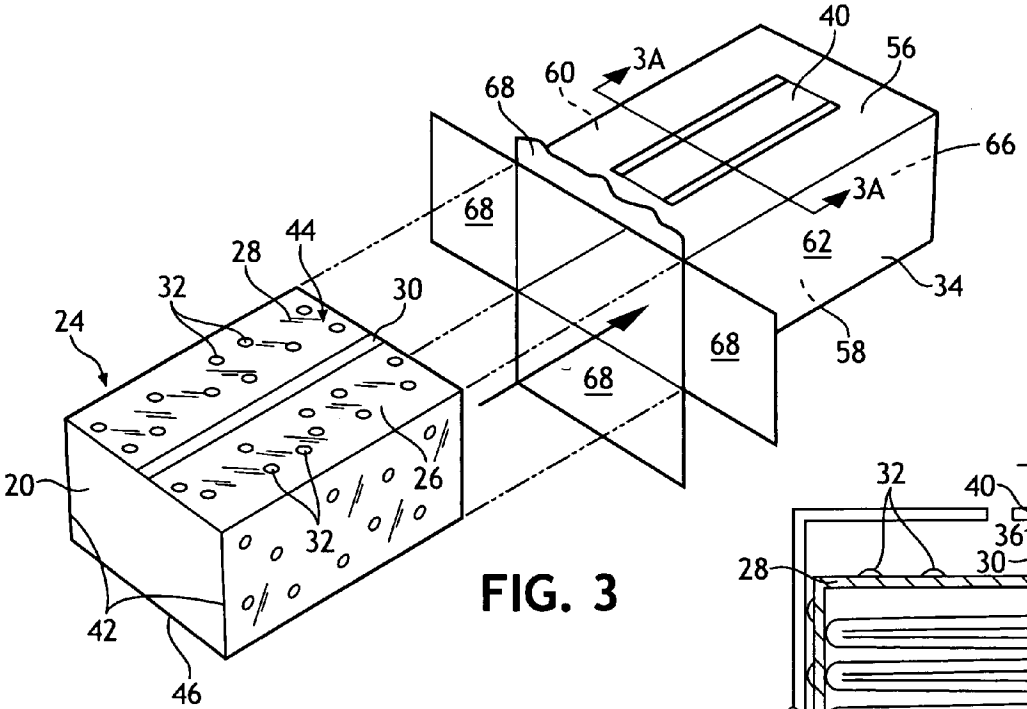
FIG. 3 is a perspective view of another embodiment of the invention.
Figure 3A:
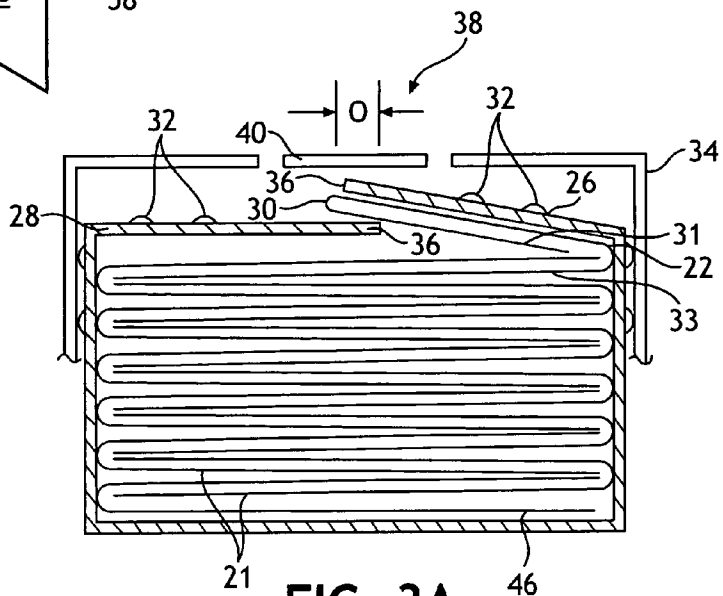
FIG. 3A is a partial cross-section view of FIG. 3.

Referring now to FIGS. 3 and 3A, another embodiment of the invention is illustrated. This embodiment is similar to the embodiment of FIG. 1 except that the dispensing panel 24 is wrapped completely around the stack 20 covering the top 44, sides 42 and bottom 46 of the stack 20. The ends of the stack 20 can be exposed if the stack is cut to length with the dispensing panel wrapped about the continuous stack. The dispensing edges 36 are located above and below the leading edge 30 of the first sheet 22 to expose the leading edge with the lower dispensing edge interleaved with the first sheet. A gap G, a slit with no gap, or an overlap O can be provided to form the dispensing orifice 38 depending on the length of the dispensing panel 24 and the perimeter of the stack 20. This embodiment entirely wraps the stack 20 in the dispensing panel 24 and can provide an advantage in transporting the stack 20 with the interleaved dispensing panel on a high speed assembly line with a lower likelihood of the dispensing panel being moved out of position.

Figure 4:
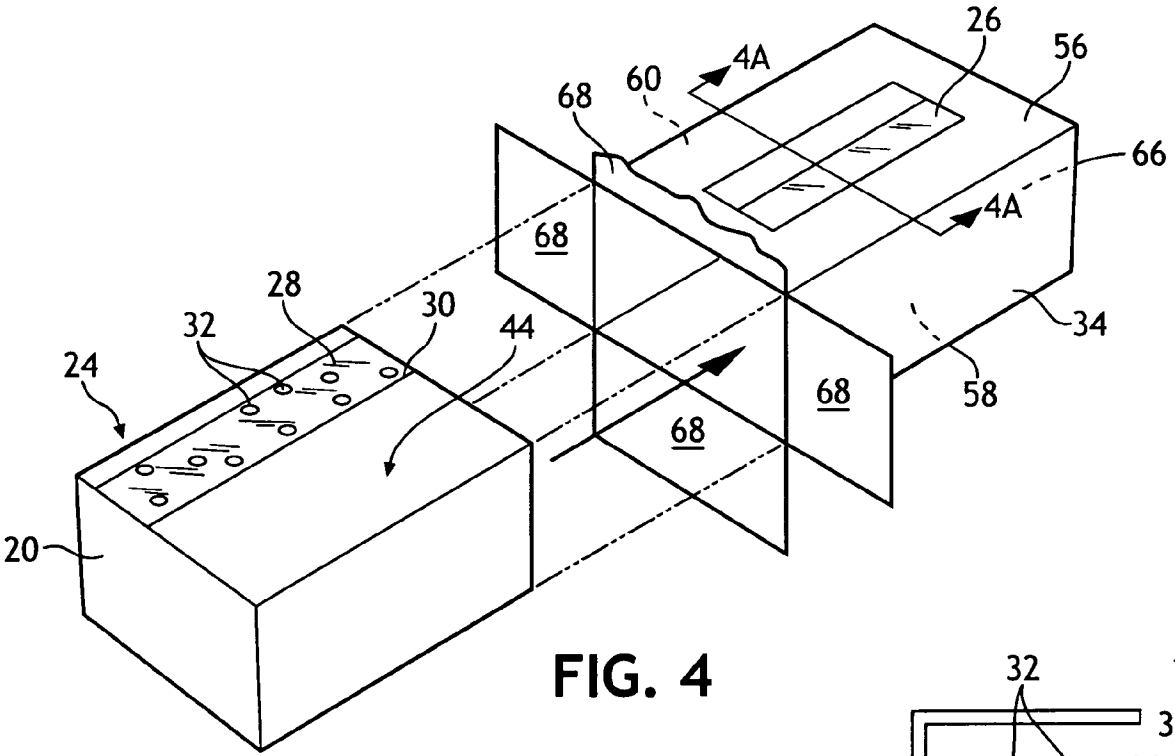
FIG. 4 is a perspective view of another embodiment of the invention.
Figure 4A:
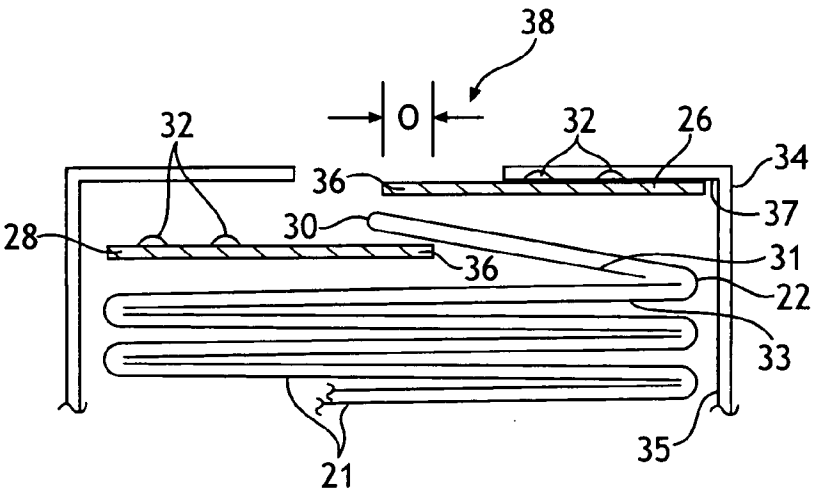
FIG. 4A is a partial cross-section view of FIG. 4.

Referring now to FIGS. 4 and 4A, another embodiment of the invention is illustrated. For clarity, the optional removable panel 40 has been omitted to see details of the dispensing orifice 38. This embodiment is similar to the embodiment of FIG. 1 except that the first side dispensing panel 26 is already attached to the top interior surface 37 of the dispenser 34. It can be provided as a portion of the carton blank that is assembled into the dispenser 34. Thus, only the second side dispensing panel 28 is placed onto the top 44 of the stack 20 and interleaved with the first sheet 22. However, once the stack 20 is inserted into the dispenser 34, a dispensing panel is formed substantially covering the top 44 of the stack. By varying the size and/or location of the first and the second side dispensing panels (26, 28), either a gap G, a slit with no gap, or an overlap O can be present between the dispensing edges 36 of the dispensing panels to form the dispensing orifice 38. This embodiment has the advantage that the non-interleaved first side dispensing panel 26 is attached to the interior surface of the dispenser 34 where it is less likely to be dislodged or moved out of position during high speed conveying of the stack 20 or during insertion of the stack into the dispenser 34. This embodiment can also be easier to implement since only the second side dispensing panel 28 is placed and interfolded with the stack 20 requiring fewer changes to the manufacturing process.

Figure 4B:
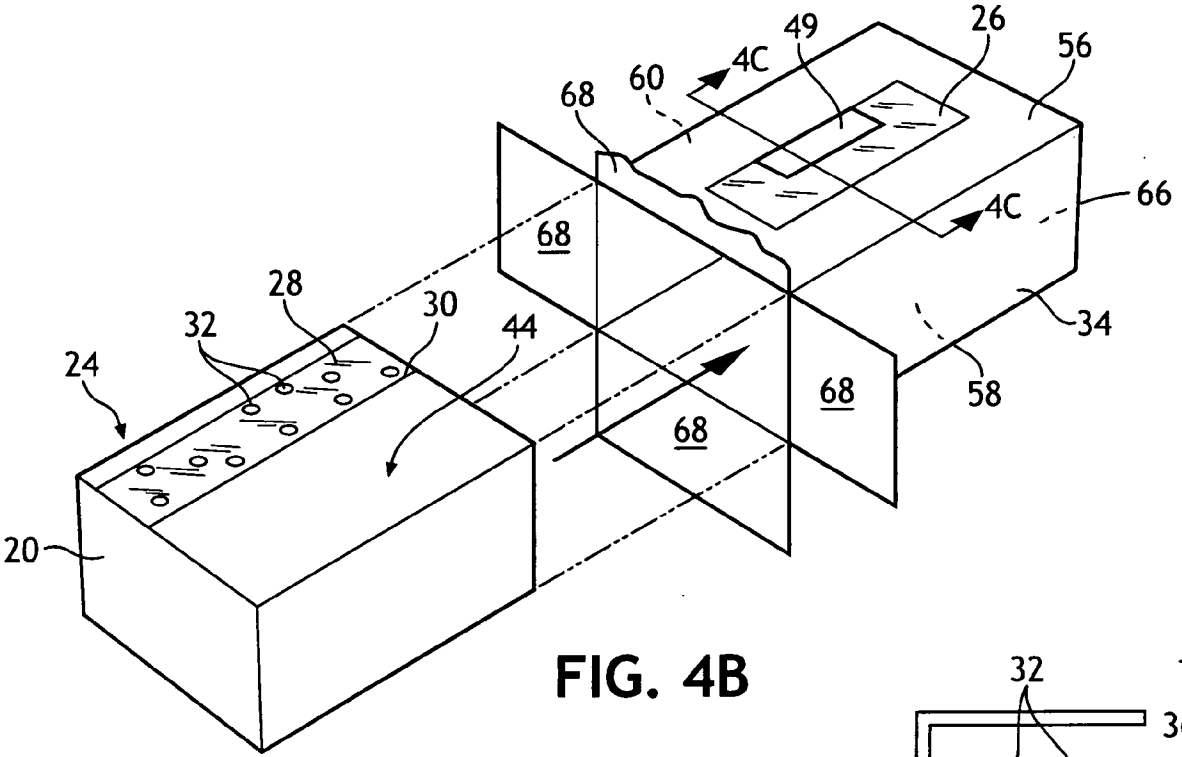
FIG. 4B is a perspective view of another embodiment of the invention.
Figure 4C:
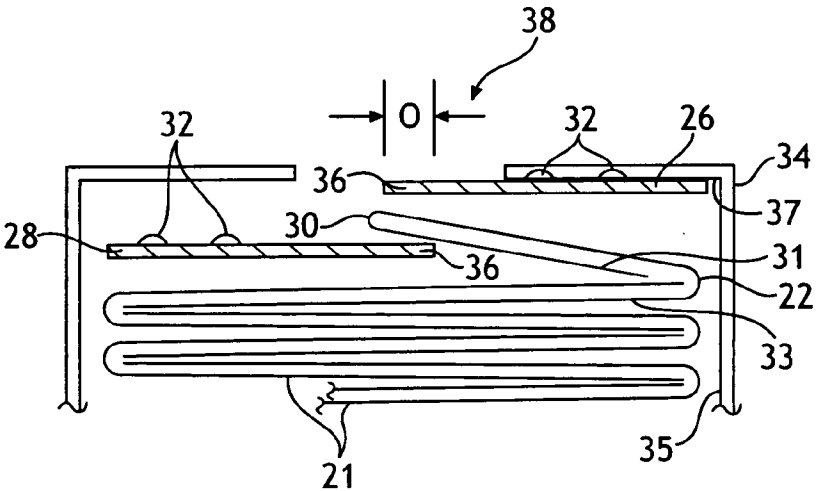
FIG. 4C is a partial cross-section view of FIG. 4B.

Referring now to FIGS. 4B and 4C, another embodiment of the invention is illustrated. For clarity, the optional removable panel 40 has been omitted to see details of the dispensing orifice 38. This embodiment is similar to the embodiment of FIG. 4A except that the first side dispensing panel 26 that is already attached to the top interior surface 37 of the dispenser 34 has an opening or cutout 49. The first side dispensing panel 26 can be provided pre-attached to a portion of the carton blank that is assembled into the dispenser 34 and has a U shape. By placing a cutout 49 in the first side dispensing panel 26, the dispensing edge 36 is made effectively shorter. As a result, the interfolded sheets 21 as they are dispensed are gathered or bunched together more as they are forced through the cutout 49. This can improve sheet-to-sheet adhesion or friction resulting in less fallback or occurrences where the next sheet in the stack is not partially withdrawn through the dispensing orifice 38. The cutout 49 can be located in either the first side dispensing panel 26 or the second side dispensing panel 29. The size or the shape of the cutout 49 can be varied in order to promote either more or less gathering of the sheet material as it is dispensed from the dispenser.

As with the embodiment of FIG. 4A, only the second side dispensing panel 28 is placed onto the top 44 of the stack 20 and interleaved with the first sheet 22. However, once the stack 20 is inserted into the dispenser 34, a dispensing panel is formed substantially covering the top 44 of the stack. By varying the size and/or location of the first and the second side dispensing panels (26, 28), either a gap G, a slit with no gap, or an overlap O can be present between the dispensing edges 36 of the dispensing panels to form the dispensing orifice 38.

Figure 5:
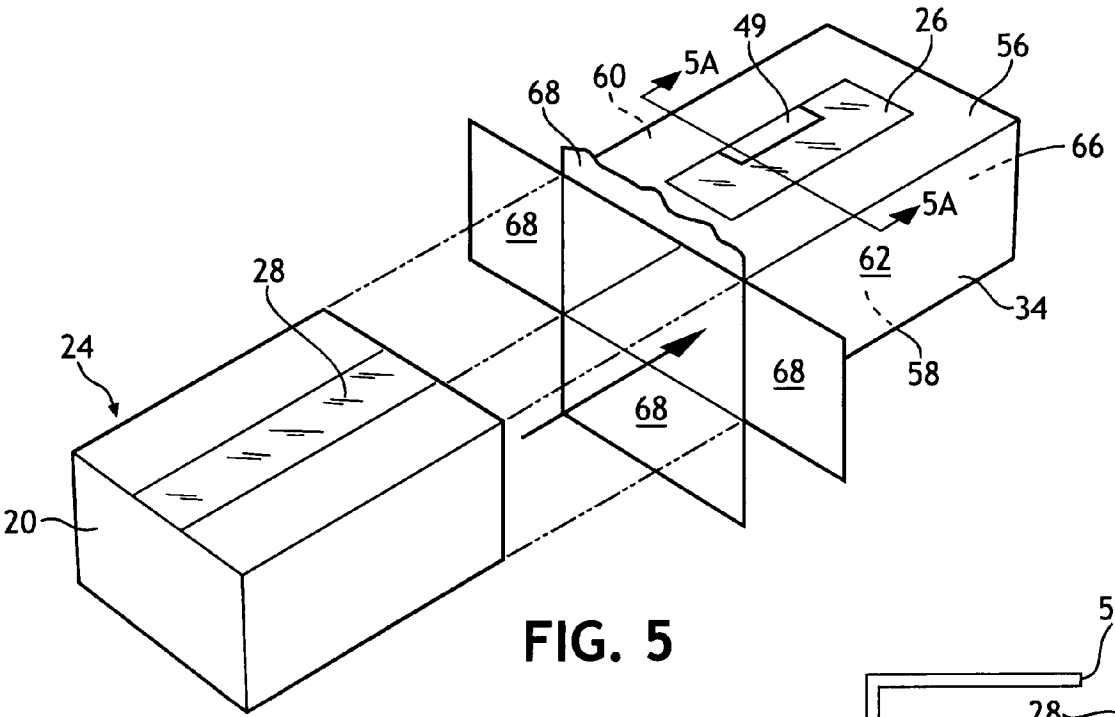
FIG. 5 is a perspective view of another embodiment of the invention.
Figure 5A:
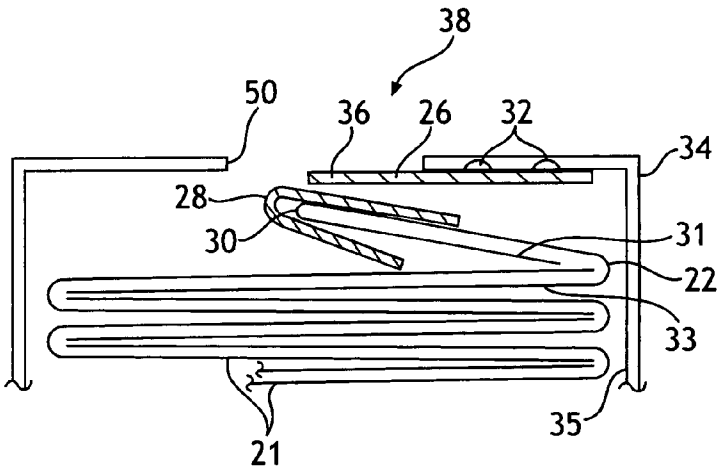
FIG. 5A is a partial cross-section view of FIG. 5.

Referring now to FIGS. 5 and 5A, another embodiment of the invention is illustrated. This embodiment is similar to the embodiment of FIGS. 4B and C except that the second side dispensing panel 28 is V-folded about the leading edge 30 of the first sheet 22. The first side dispensing panel 26 is pre-attached to the interior surface 35 of the dispenser 34 leaving the cutout 49 that functions as a dispensing orifice 38 between the dispensing edge 36 of the first side dispensing panel 26 and a dispensing opening 50 in the top of the dispenser 34. In this embodiment, the second side dispensing panel 28 is a sacrificial piece that is initially grabbed to start the first sheet 22 and then is discarded. While this embodiment requires the user to insert their fingers into the dispenser to find the leading edge 30, the V-folded second side dispensing panel 28 that is wrapped about the leading edge 30 makes it far less likely that the leading edge will tear as the first sheet is withdrawn. The tear strength of a film material can be much greater than a typical tissue sheet. In order to enhance the ability of easily locating the leading edge 30, the second side dispensing panel 28 can be formed from a contrasting color with regard to the first sheet 22 and/or the first side dispensing panel 26. Additionally, the second side dispensing panel 28 can be printed with coupons, promotional messages, trademarks or brand names, motivational messages, wellness or health information, recipes, or other information to enhance the user's interaction and usage of the product; especially to promote the usage of facial tissue.

Figure 6:
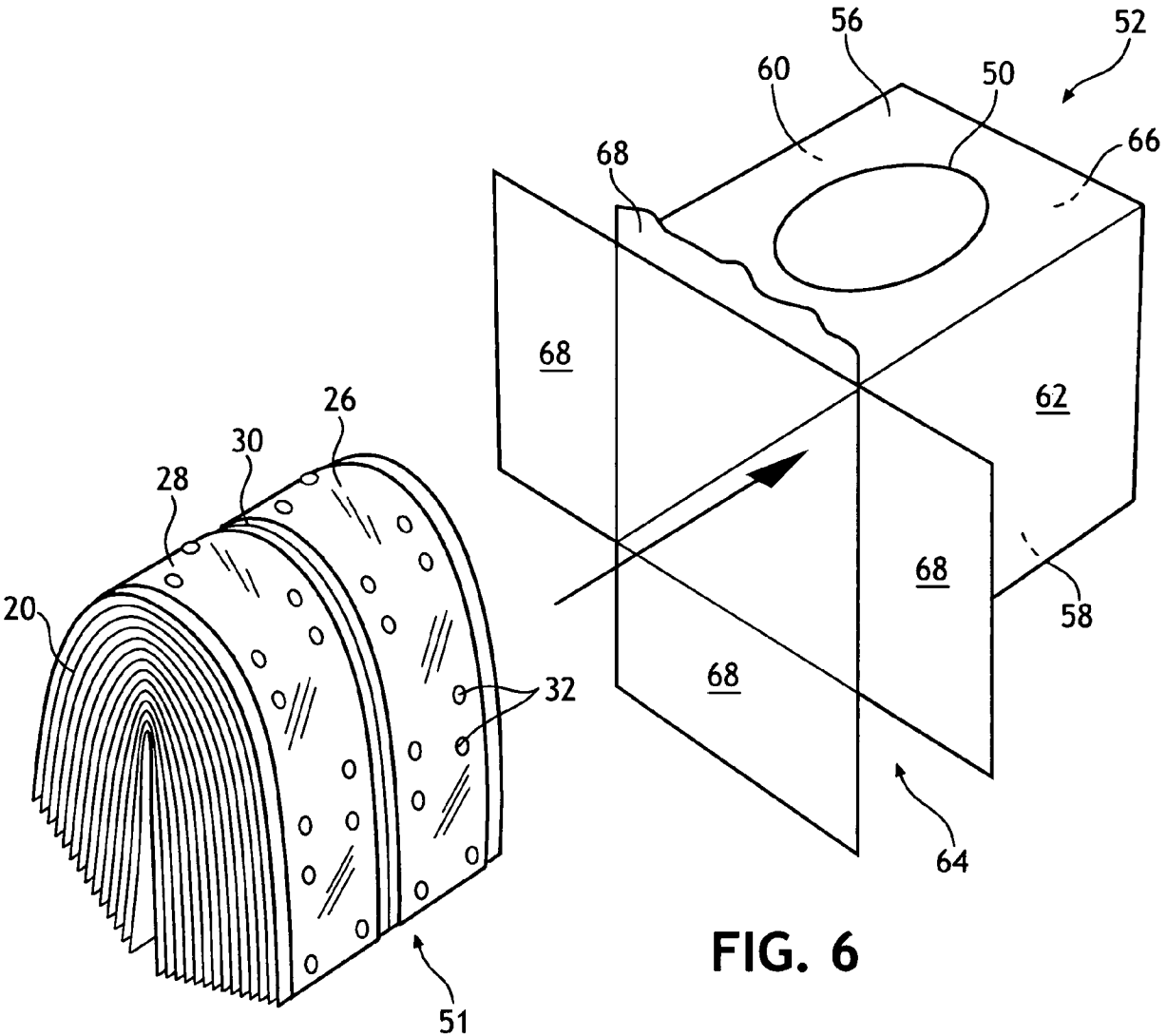
FIG. 6 is a perspective view of another embodiment of the invention.

Referring now to FIG. 6, another embodiment of the invention is illustrated. This embodiment is similar to the embodiment of FIG. 1 except that the stack 20 is folded into a U-shaped stack 51 and inserted into an upright dispenser 52. As such, any of the previous embodiments discussed or illustrated are compatible with either flat or upright dispensers and the invention is not limited to the size or shape of the dispenser 34 and/or the stack 20.

In the various embodiments described, the adhesive 32 can be a pressure sensitive adhesive, hot melt adhesive, radio frequency activated adhesive, two-part adhesive, contact cement, tape, double sided adhesive tape, or other suitable adhesive as known. In the various embodiments of the invention, the adhesive can be applied to the dispensing panel 24, the interior surface 35 of the dispenser 34, or to both surfaces. The adhesive 32 can be located in a recess or depression 54 on the interior surface 35 of the dispenser 34, such as in a recess fully or partially surrounding the dispensing opening 50 as shown in FIGS. 2 and 2A. Locating the adhesive in a recess can prevent the carton sleeves from sticking in a flattened position, yet allow the dispensing panel 24 to contact the adhesive 32 to attach the dispensing panel(s) to the interior surface 35 of the dispenser 34. The dispensing panel 24 can be made from a more flexible material allowing for contact with the adhesive whereas the stiffer carton blank material does not touch the adhesive in the recess. In the embodiment shown in FIG. 2, a trough or recess 54 surrounds the dispensing opening 50 on the top interior surface 37 of the dispenser 34 and an adhesive 32 is located in the trough.

The dispensing panel 24 can be electrostatically charged. By charging the dispensing panel, dust or lint may tend to stick to the dispensing panel reducing the amount of lint created during dispensing. Additionally, by charging the dispensing panel 24 either positively or negatively with regard to the stack 20, or by creating a charge potential between the stack and the dispensing panel, the dispensing panel can stick, cling, or be attracted to the stack. This can assist with keeping the dispensing panel 24 positioned as the stack 20 is conveyed during manufacturing or while the stack 20 is inserted into the dispenser 34. For example, the dispensing panel 24 can be charged either positively or negatively as it is unwound by using a static induction device such that it clings to or is attracted to the stack 20.

In various embodiments of the invention, the gap G can be between about 0.5 mm to about 20 mm, or between about 0.5 mm to about 10 mm, or between about 0.5 mm to about 5 mm, or between about 0.5 mm to about 2 mm. In various embodiments of the invention, the overlap distance O can be between about 0.5 mm to about 20 mm, or between about 0.5 to about 10 mm, or between about 0.5 to about 5 mm. Alternatively, the dispensing edges 36 can be adjusted such that they touch or meet and the gap G is 0 mm. The dispensing edges 36 can be linear, wavy, curved, zigzag or have a cutout.

In various embodiments of the invention, the dispensing panel 24 can be interleaved with any of the sheets in the stack 20 such as with the second, third, or fourth sheet in the stack, including the first sheet 22. For example, the first sheet and second sheet in the stack can be folded together into a J-fold as shown in FIG. 2 of U.S. Pat. No. 5,868,276 such that the first and second sheets are both dispensed when the leading edge 30 is grasped. For such an embodiment, the dispensing panel 24 could be interleaved between the first and third sheets in the stack to expose the leading edge 30.

The leading edge 30 can be a single thickness of a sheet, a doubled over thickness of a sheet such as the folded edge shown in FIG. 1, or a triple or quadruple or other folded thickness of the sheet. The leading edge 30 can be a single thickness of two or more sheets or the folded edge of two or more sheets as shown in FIG. 2 of U.S. Pat. No. 5,868,276. The leading edge is the portion of the sheet(s) that can be exposed from the dispensing panel 24 used to start the dispensing process.

The dispenser 34 can be made from paperboard, cardboard, coated paperboard, carton stock, or other paper materials comprising cellulose. Alternatively, the dispenser can be made from plastic, films, metallic foils, wood or other materials. In one embodiment, the dispenser 34 comprised six panels including a top panel 56, a bottom panel 58, a left side panel 60, a right side panel 62, a left end panel 64, and a right end panel 66 forming a parallelepiped shape. The dispensing opening 50 can be located in the top panel 56 or another panel of the dispenser 34. The dispensing opening 50 can be any suitable size or shape such as rectangular, oval, or circular. As previously described, the dispensing orifice 38 is created by the gap, overlap, or slit with no gap created by the dispensing panel 24 which can be attached to the interior surface 35 of the dispenser 34 after being interleaved with the stack 20. To facilitate filling the dispenser on an automated cartoner, the left and right end panels (64, 66) can comprise a plurality of flaps 68 which are folded shut and glued to seal the dispenser. For clarity in the drawings, the top flap has been cut away to illustrate more of the top panel 56.

Other modifications and variations to the present invention may be practiced by those of ordinary skill in the art, without departing from the spirit and scope of the present invention, which is more particularly set forth in the appended claims. It is understood that aspects of the various embodiments may be interchanged in whole or part. All cited references, patents, or patent applications in the above application for letters patent are herein incorporated by reference in a consistent manner. In the event of inconsistencies or contradictions between the incorporated references and this application, the information present in this application shall prevail. The preceding description, given by way of example in order to enable one of ordinary skill in the art to practice the claimed invention, is not to be construed as limiting the scope of the invention, which is defined by the claims and all equivalents thereto.

We claim:

1. A product comprising a dispenser having a removable panel covering at least a portion of a dispensing opening, the dispenser containing a stack of interfolded sheets having a top sheet and having at least one dispensing panel positioned below the removable panel and interleaved with the top sheet of the stack, wherein the dispensing panel comprises a first side dispensing panel and a second side dispensing panel, the first side dispensing panel placed over at least a portion of a first sheet in the stack and the second side dispensing panel interleaved with at least a portion of the first sheet such that a leading edge of the first sheet is exposed between the first side and the second side dispensing panels, and wherein the stack comprises a top and a pair of opposing sides, and the first side dispensing panel extends over a portion of the top and a portion of one of the sides of the stack, and the second side dispensing panel extends over a portion of the top and a portion of the opposing side of the stack.

2. The product of claim 1 wherein the first side and the second side dispensing panels each comprise a dispensing edge and an overlap is present between the dispensing edges.

3. The product of claim 1 wherein the first side and the second side dispensing panels each comprise a dispensing edge and a gap is present between the dispensing edges.

4. The product of claim 1 wherein the stack comprises tissue sheets and the first tissue sheet is J-folded.

5. The product of claim 1 wherein the stack is placed into a dispenser having a dispensing opening, and the at least one dispensing panel is attached to an interior surface of the dispenser such that at least a portion of the dispensing panel extends into the dispensing opening.

6. The product of claim 5 wherein the at least one dispensing panel comprises a pair of dispensing edges and an overlap is present between the dispensing edges.

7. The product of claim 1 wherein the stack is placed into a dispenser and the first side and the second side dispensing panels are attached to an interior surface of the dispenser such that at least a portion of the first side and the second side dispensing panels extend into the dispensing opening.

8. The product of claim 1 wherein the stack is placed into a dispenser having a dispensing opening, the at least one dispensing panel is attached to an interior surface of the dispenser such that at least a portion of the dispensing panel extends into the dispensing opening leaving a leading edge of the first sheet of the stack exposed, and attaching the leading edge to a removable panel of the dispenser.

9. The product of claim 1 wherein the stack is placed into a dispenser, the at least one dispensing panel comprises a first side dispensing panel and a second side dispensing panel, the first side dispensing panel attached to an interior surface of the dispenser prior to insertion of the stack, and the second side dispensing panel interleaved with at least a portion of the first sheet and attached to an interior surface of the dispenser after inserting the stack into the dispenser such that a leading edge of the first sheet is exposed between the first side and the second side dispensing panels.

10. The product of claim 9 wherein the first side dispensing window comprises a cutout.

11. The product of claim 9 wherein the at least one dispensing panel comprises a pair of dispensing edges and an overlap is present between the dispensing edges.

12. The product of claim 1 wherein the stack is placed into a dispenser, the at least one dispensing panel comprises a first side dispensing panel and a second side dispensing panel, the first side dispensing panel attached to an interior surface of the dispenser, and the second side dispensing panel V-folded about a leading edge of a first sheet such that the second side dispensing panel is dispensed when the first sheet is removed.

13. The product of claim 1 wherein the stack is folded into a U-shaped stack.

14. A product comprising a dispenser having a removable panel covering at least a portion of a dispensing opening, the dispenser containing a stack of interfolded sheets having a top sheet and having at least one dispensing panel positioned below the removable panel and interleaved with the top sheet of the stack, wherein the stack comprises a top, a bottom, and a pair of opposing sides and the at least one dispensing panel is wrapped around the top, the bottom, and the opposing sides of the stack leaving a leading edge of a first sheet of the stack exposed.

15. The product of claim 14 wherein the dispensing panel comprises a pair of dispensing edges and an overlap is present between the dispensing edges.

16. The product of claim 14 wherein the dispensing panel comprises a pair of dispensing edges and a gap is present between the dispensing edges.

* * * * *